United States Patent [19]

Goulart

[11] 4,371,022

[45] Feb. 1, 1983

[54] GOLF CLUB CADDY

[76] Inventor: Joseph G. Goulart, 5372 Clairemont Mesa Blvd., San Diego, Calif. 92117

[21] Appl. No.: 266,716

[22] Filed: May 26, 1981

[51] Int. Cl.[3] ..... A63B 55/00

[52] U.S. Cl. ..... 150/1.5 R

[58] Field of Search ..... 150/1.5 R, 1.5 B, 1.5 C, 150/52 G; 206/315 R; 224/251; 273/32 E

[56] References Cited

U.S. PATENT DOCUMENTS

| | | | |
|---|---|---|---|
| 1,314,171 | 8/1919 | Vogel | 150/1.5 |
| 1,443,230 | 1/1923 | Luckett | 150/1.5 X |
| 2,485,864 | 10/1949 | Cohen et al. | 150/1.5 X |
| 2,486,827 | 11/1949 | Duncan | 150/1.5 |
| 2,716,432 | 8/1955 | Duffy | 150/1.5 |
| 2,887,137 | 5/1959 | Robb | 150/1.5 |

*Primary Examiner*—William Price
*Assistant Examiner*—Sue A. Weaver
*Attorney, Agent, or Firm*—Brown & Martin

[57] ABSTRACT

A compact, light weight, unitary golf club carrier and golf stand adaptor to replace a conventional golf bag. Clubs are carried by a hand grip on the carrier with the clubs in a balanced position. When the golfer is not carrying the clubs, a retainer ring is quickly opened and the club shafts are spread apart to engage the ends of the shafts with the ground and form a golf club stand held in position by the club shafts and the throat portion of the carrier which is in contact with the intermediate portion of the club shafts.

8 Claims, 7 Drawing Figures

FIG. 1
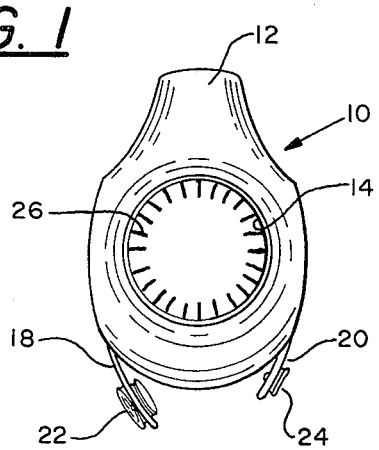
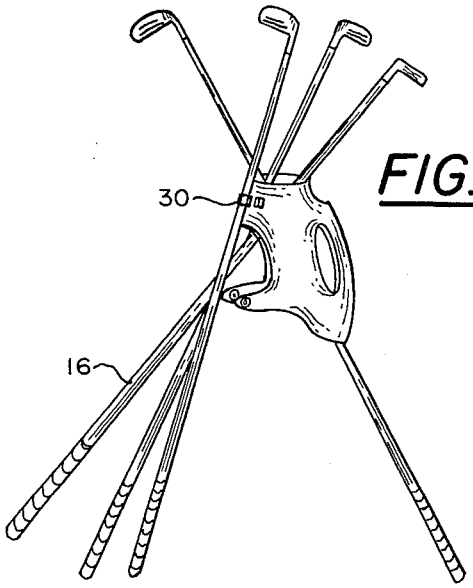
FIG.5
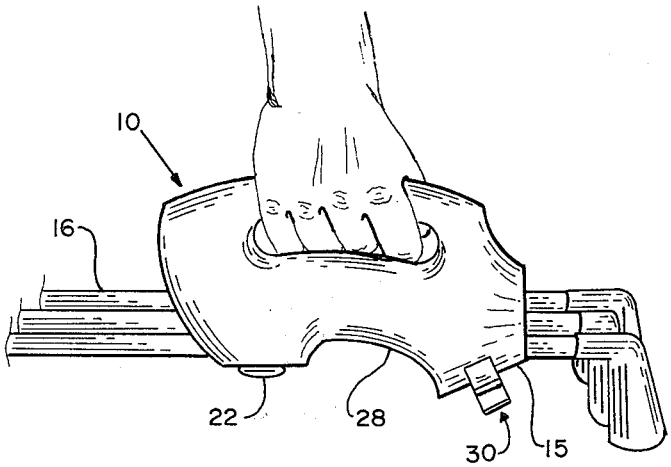
FIG. 2
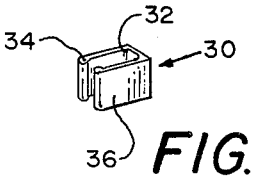
FIG. 4
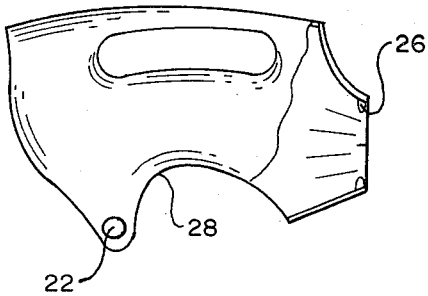
FIG. 3

GOLF CLUB CADDY

BACKGROUND OF THE INVENTION

The present invention relates to a light weight combination golf club carrier and support stand adaptor whereby golf clubs can easily be carried from place to place and the clubs can quickly and easily be arranged from a standing position when they are placed in the location with the grip ends on the ground.

Golf has become an increasingly popular sport over the years. Full size golf courses are extremely expensive to build and require a large amount of land. They are usually built within a fairly short distance from population centers so that they can draw upon a large number of golfers. The result is that full size 18 hole courses are extremely crowded. These crowded conditions result in an impractical amount of time required to play a round of golf with much time being spent waiting at the tee or in the fairway for golfers in the proceeding group. Mechanized golf carts have been made mandatory at some golf courses to speed up the play and in some instances sand traps have been eliminated to alleviate the problem. However, crowded conditions continue to exist and many golfers have turned to more often playing shorter courses which require mostly iron play with an occasional hole that requires a wood such as a driver or a three wood.

In playing such shorter courses, a full compliment of thirteen or fourteen clubs is not required. A typical array of clubs for such play would be a three, five, seven and nine iron, and a putter. A three wood might be added for courses which include a hole or holes that are too long for an iron shot at the tee.

Previous attempts at providing golf club carrying devices for carrying less than a full complement of clubs have been awkward and difficult to handle. Some are heavy, some have several component parts which renders them expensive to manufacture and assemble. Carriers with multiple large loops have been suggested but the clubs slide within such construction. Other devices have awkward carrying arrangements and provide an unbalanced condition when carrying the clubs. Still others utilize sticks or staffs with ground engaging tips or spikes so that the clubs can be stacked when waiting on the fairway.

Due to the awkward construction of the prior devices, their weight, and the use of designs which are difficult to manufacture and assemble, golfers have not accepted such carriers even though they have a substantial advantage over a full, heavy conventional golf bag.

SUMMARY OF THE INVENTION

The present invention overcomes the deficiencies of the prior art with a unitary light weight combination golf club carrier and golf stand adaptor which can be readily made in a plastic injection mold with a substantially cylindrical body having a hand grip formed therein. A club shaft retaining structure is formed in said body including a throat and flared neck portion at the forward end and a closure ring at the other end. The closure ring can be quickly and easily closed for the carrying position of the clubs and opened for spreading the club shafts into the neck to provide a stocked array of the clubs with their grip ends contacting the ground, the clubs providing the sole support and eliminating the necessity of additional supporting rods or the like.

It is the object of the present invention to provide a new and improved golf club carrier and golf stand adaptor construction which is light weight and which can be readily manufactured in one piece in a plastic injection mold.

It is another object of the present invention to provide a new and improved golf club carrier and golf stand adaptor which is easy to carry and wherein the clubs are carried in a well balanced position.

It is another object of the present invention to provide a golf club carrier and golf stand adaptor wherein the device is quickly and easily manipulated to remove a club and provide a club stand wherein the clubs and carrier are supported by spreading the grip ends of the golf clubs outward so that the sole means for supporting the club array is the grip ends of the golf club in contact with the ground.

It is a further object of the present invention to provide a one piece golf club carrier and stand adaptor wherein necessary equipment such as golf balls and tees can be carried and easily removed.

DESCRIPTION OF THE DRAWINGS

FIG. 1 is a front end elevation of a first embodiment of the golf club carrier and stand adaptor of the present invention with the closure straps unfastened.

FIG. 2 is a side elevation of the golf club carrier and stand adaptor of FIG. 1 with the closure straps fastened and several golf clubs being carried.

FIG. 3 is a side elevation of the golf club carrier and golf stand adaptor of FIG. 1 with the closure straps unfastened, and partially sectioned to show interior construction.

FIG. 4 is perspective view of a clip which can be affixed to the golf club carrier and support stand adaptor of FIG. 1.

FIG. 5 is a perspective view showing the golf club carrier and golf stand adaptor of FIG. 1 in the open position with golf clubs stacked in a supporting array and with the grip ends contacting the ground.

DETAILED DESCRIPTION OF INVENTION

Figure 6:
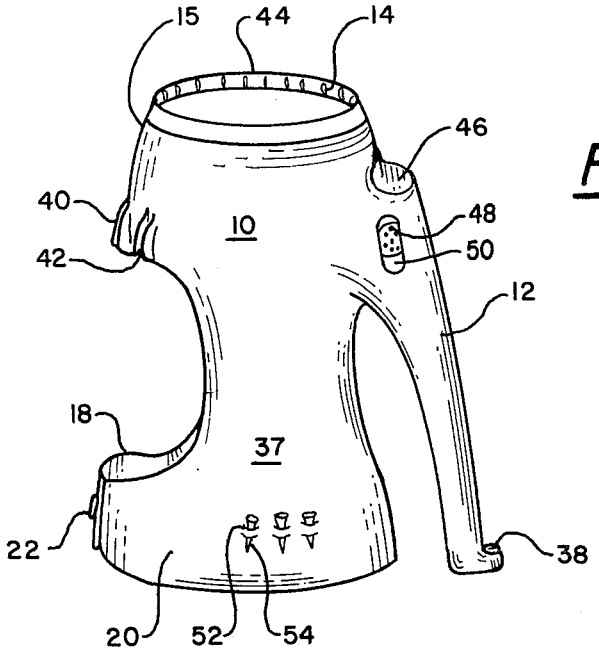
FIG. 6 is a perspective view of a second embodiment of the golf club carrier and golf stand adaptor of the present invention.

Referring to the drawings, a first embodiment of the golf club carrier and golf stand adaptor of the present invention comprises a substantially cylindrical body 10 formed of a flexible material with sufficient rigidity to maintain its general shape. The body 10 includes a hand grip 12 which is curved to provide a comfortable fit for the hand of the user. The forward end of the body has a throat portion 14 through which golf club shafts 16 can be inserted with the club heads positioned outside the carrier in the carrying position as shown in FIG. 2. The throat diameter is smaller than the length of a golf club head and its axis is tilted upwardly relative to the handle grip 12 and neck portion 15 flares downwardly and extends below the cylindrical body 10. The club shafts extend generally along the axial direction of the body and are held in place by a pair of straps 18 and 20 formed integral with the body 10. The strap 18 has the female half 22 of a quick connect press on button fastener adjacent its end and the strap 20 has the male half 24 of the fastener adjacent its end. The straps form a closure ring which is substantially coincident with the shape of said cylindrical body in the fastened position. The body 10 can have reinforcing ribs 26 formed thereon extending radially inward toward the center of the throat 14. These ribs engage a portion of the club shafts to keep them positioned and are sufficiently short and flexible to permit movement of the club shafts when moving them to the stacked position as described hereafter.

The body 10 has a portion cut away in the bottom to form a passage 28 adjacent neck portion 15 when the straps 16 and 18 are unfastened so that the shafts 16 of the clubs can be spread apart, as shown in FIG. 5 of the drawing for positioning on the ground to form a golf club stand. The flared neck portion 15 accommodates the spreading of the club shafts from the carrying position. No special sticks, rods or staffs are required to support the stand. The arrangement and configuration of the device of the present invention mades it extremely easy to unsnap the straps and move the clubs to the position shown in FIG. 5. When the user moves again with the clubs, the shafts are simply gathered together by the user and the fastener 22–24 is quickly engaged.

When the user desires to remove a club from the carrier for a golf shot, he can withdraw it endwise through the throat 14 before unfastening the straps 18 and 20 or he can unfasten the straps and stack the clubs before removing the club he desires to use.

A clip or clips 30 such as the one shown in FIG. 4 of the drawing can be affixed to the outside of the body 10 with a suitable adhesive such as an epoxy glue. The clip 30 has a back portion 32 and two forwardly extending flexible arms 34 and 36. It can be formed of a spring type metal or a flexible plastic. The arms 34 and 36 curve inwardly so that when a golf club shaft is inserted between them they are spread and then return to their initial position to retain the club shaft in place. This provides additional means for supporting club shafts to form the golf club stand.

A second embodiment of the present invention is illustrated in FIG. 6 of the drawings. In this embodiment, the body 10 includes the throat 14 and the hand grip 12 formed of a thicker plastic. A cylindrical skirt 37 of thinner section, which is more flexible, extends from the body 10 and includes the straps 18 and 20 connected by the fastener 22–24 in the carrying position. The rigid hand grip has a club slot 38 formed therein and two club slots 40 and 42 are formed in the lower portion of the body 10. These slots can be used to provide a tripod support by inserting golf club shafts therein. Ridges 44 are formed in the throat 14 to help engage the club shafts 16 in a firm position when the club shafts are spread and stacked as shown in FIG. 5 of the drawing.

A ball pocket 46 is formed in the body 10 adjacent the hand grip 12 to accommodate one or two golf balls 48. A slot 50 is located along the pocket 46 so that the user can engage the side of golf ball through the slot with his finger or thumb to move the ball out of the pocket. The pocket is of a dimension relative to the ball that provides a tight sliding fit with the ball so that it is retained in the pocket but can be slid out for removal.

The skirt includes notches 52 for retaining golf tees 54 therein. The result is a unitary, simple, light weight golf club carrier and golf stand adaptor that accommodates accessories such as tees and golf balls in its intregal construction. The handle, in this modification is also positioned at an angle relative to the throat 14 to permit carrying the clubs in a balanced position.

Figure 7:
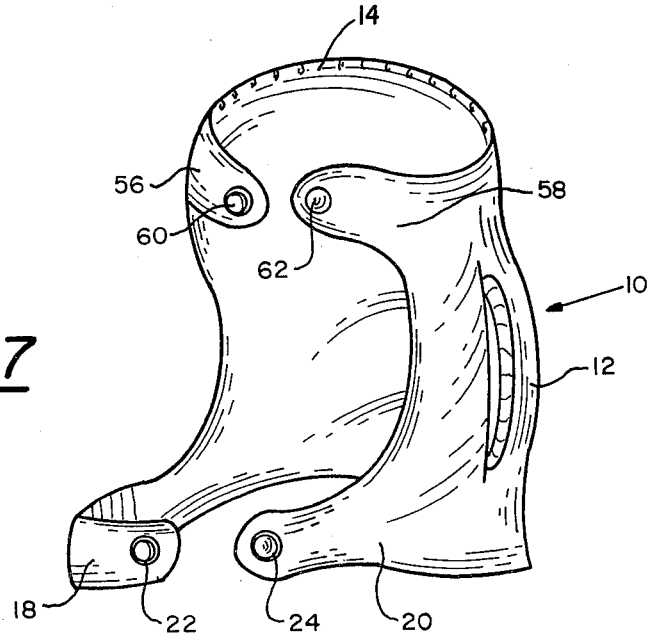
FIG. 7 is a perspective view of a third embodiment of the golf club carrier and golf stand adaptor of the present invention.

A third embodiment of the present invention is illustrated in FIG. 7 of the drawings. This embodiment is similar to the first embodiment illustrated in FIGS. 1 through 5. Additionally, the throat portion 14 of the body 10 has a pair of straps 56 and 58. The strap 56 has the female half 60 of a quick connect press on button fastener adjacent its end. The strap 58 has the male half 62 of the fastener adjacent its end. The straps 56 and 58 form a closure ring which defines the throat portion 14 when fastened. They may be unfastened along with the lower straps 18 and 20, to allow rapid removal and replacement of all of the clubs at once.

Having thus described various embodiments of my invention, it will be apparent that further embodiments will occur to those skilled in the art. Therefore, the protection afforded my invention should be limited only in accordance with the scope of the following claims:

I claim:

1. A one piece combination golf club carrier and golf stand adaptor, comprising:

a light weight substantially cylindrical, hollow body of flexible material with sufficient rigidity to maintain its general shape and having a hand grip at the top thereof;

a portion of said body beneath said hand grip being cut away to form a club shaft passage with retaining ring straps extending from the bottom of said body at the rear portion of said body adjacent said passage;

fastening means on said straps for permitting quick fastening and unfastening of said straps;

a substantially circular open throat at the forward end of said body tilted upwardly relative to said body axis and smaller in diameter than the length of a golf club head;

a neck portion flaring downwardly from said throat and extending below said body;

said body constituting a golf club carrier when said straps are fastened to form a retaining ring for retaining several golf clubs within said throat hollow body, and retaining ring and out the open back of said hollow body; and said body forming a golf club stand adaptor with at least three of said golf club shafts when said straps are unfastened and said golf club shafts are extended through said passage and into said flared neck portion with said stand supported on the ground solely by the ends of said club shafts and with said throat engaging said club shafts intermediate their ends for maintaining said clubs in the spread position.

2. A combination golf club carrier and golf stand adaptor according to claim 1 including reinforcing ribs, on the interior of said hollow body adjacent said throat extending a short distance from said throat and radially inward part way toward the center of said body.

3. A combination golf club carrier and golf stand adaptor according to claim 1 including at least one golf club shaft retaining clip positioned on the outside of said body, said clip having spring-like arms which are spread to accommodate a club shaft and that hold the club shaft in the mounted position.

4. A combination golf club carrier and golf stand adaptor according to claim 1 wherein said hand grip and the forward end of the body, including the throat and neck portion, are of a thicker section and more rigid than the rest of the body; and the remainder of the body forms a flexible skirt.

5. A combination golf club carrier and golf stand adaptor according to claim 4 wherein the hand grip includes a club shaft receiving groove formed in a boss extending from the top of said hand grip; and two club shaft receiving grooves are formed on the bottom of said body between said passage and said throat.

6. A combination golf club carrier and golf stand adaptor according to claim 4 wherein a golf ball retainer pocket is provided in said body between said hand grip and said throat for accepting at least one golf ball; and slot means is provided along at least one side of said golf ball pocket for removing said ball by contacting the ball through said slot and sliding the ball toward the front of said carrier and out of said pocket.

7. A combination golf club carrier and golf stand adaptor according to claim 6 wherein notches are provided on the exterior of said body portion to form means for seating golf tees.

8. A combination golf club carrier and golf stand adaptor according to claim 1 wherein said neck portion includes a pair of throat defining straps and said combination further comprises:

second fastening means on said throad defining straps for permitting quick fastening and unfastening of said throat defining straps.

* * * * *

UNITED STATES PATENT AND TRADEMARK OFFICE

CERTIFICATE OF CORRECTION

PATENT NO. : 4,371,022

DATED : February 1, 1983

INVENTOR(S) : Joseph G. Goulart

It is certified that error appears in the above-identified patent and that said Letters Patent are hereby corrected as shown below:

Column 6, line 14, Claim 8, after the word "said", change "throad" to --throat--.

Signed and Sealed this

*Nineteenth* Day of *April 1983*

[SEAL]

*Attest:*

GERALD J. MOSSINGHOFF

*Attesting Officer*

*Commissioner of Patents and Trademarks*